US008529222B2

(12) United States Patent
Burns et al.

(10) Patent No.: US 8,529,222 B2
(45) Date of Patent: Sep. 10, 2013

(54) SURFACE PUMP ASSEMBLY HAVING A THRUST CHAMBER WITH A TELESCOPING SHAFT

(75) Inventors: Timothy Donald Burns, McAlester, OK (US); Jason Neal Whaley, Hartshorne, OK (US)

(73) Assignee: National Oilwell Varco, L.P., Houston, TX (US)

( * ) Notice: Subject to any disclaimer, the term of this patent is extended or adjusted under 35 U.S.C. 154(b) by 535 days.

(21) Appl. No.: 12/773,051

(22) Filed: May 4, 2010

(65) Prior Publication Data

US 2010/0284830 A1 Nov. 11, 2010

Related U.S. Application Data

(60) Provisional application No. 61/175,706, filed on May 5, 2009.

(51) Int. Cl.

| | |
|---|---|
| ***F04D 29/044*** | (2006.01) |
| ***F04D 29/08*** | (2006.01) |
| ***F04D 29/60*** | (2006.01) |
| ***F16C 3/03*** | (2006.01) |

(52) U.S. Cl.
USPC ... 417/360; 417/365; 417/423.6; 29/888.021; 464/162; 277/370; 277/511

(58) Field of Classification Search
USPC ..... 417/281, 360, 365, 423.6; 29/888.021; 464/162, 163, 164, 165, 166, 167, 168, 169; 277/370, 510, 511
See application file for complete search history.

(56) References Cited

U.S. PATENT DOCUMENTS

| | | | | |
|---|---|---|---|---|
| 2,209,109 | A * | 7/1940 | Bungartz | 415/140 |
| 2,830,801 | A * | 4/1958 | Stratienko et al. | 366/249 |
| 3,282,614 | A * | 11/1966 | Entrikin | 403/182 |
| 3,918,272 | A * | 11/1975 | Honold et al. | 464/162 |
| 3,949,567 | A * | 4/1976 | Stech | 464/154 |
| 4,975,184 | A * | 12/1990 | McEwen | 210/136 |
| 5,030,346 | A * | 7/1991 | McEwen | 210/258 |
| 5,098,343 | A * | 3/1992 | Tysver et al. | 464/169 |
| 5,779,434 | A * | 7/1998 | De Long | 415/104 |
| 5,957,656 | A | 9/1999 | De Long | |
| 6,425,735 | B1 * | 7/2002 | Sheth | 415/134 |
| 6,461,115 | B1 * | 10/2002 | Ferrier et al. | 417/53 |
| 6,779,608 | B2 | 8/2004 | Grubb et al. | |
| 7,104,766 | B2 * | 9/2006 | Mascola | 417/365 |

(Continued)

OTHER PUBLICATIONS

"Mission Multistage Surface Pump Brochure"; The American Oil & Gas Reporter; Jan. 2008.

(Continued)

*Primary Examiner* — Charles Freay
*Assistant Examiner* — Nathan Zollinger
(74) *Attorney, Agent, or Firm* — Conley Rose, P.C.

(57) ABSTRACT

A surface pump assembly having a thrust chamber with a telescoping shaft. In some embodiments, the surface pump assembly has a pump with a pump shaft, a thrust chamber with a telescoping shaft extending therein, the telescoping shaft extendable to engage the pump shaft and retractable to disengage the pump shaft, and a motor coupled to the telescoping shaft and operable to rotate the telescoping shaft. In some embodiments, the telescoping shaft has a rotatable shaft member, an adjusting nut threadably disposed thereabout, wherein the adjusting nut is moveable axially relative to the shaft member by rotation, and a first sleeve translatably disposed about the shaft member.

15 Claims, 10 Drawing Sheets

(56) References Cited

U.S. PATENT DOCUMENTS

| | | | | |
|---|---|---|---|---|
| 7,326,034 | B2 | 2/2008 | Sheth et al. | |
| 7,353,886 | B2 | 4/2008 | Bloom et al. | |
| 7,775,779 | B2 * | 8/2010 | Sheth et al. | 417/423.6 |
| 8,246,251 | B1 * | 8/2012 | Gardner | 384/420 |
| 2003/0219347 | A1 * | 11/2003 | Mascola | 417/365 |
| 2007/0059166 | A1 | 3/2007 | Sheth et al. | |
| 2007/0086906 | A1 | 4/2007 | Horley et al. | |
| 2007/0110593 | A1 * | 5/2007 | Sheth et al. | 417/319 |
| 2007/0116560 | A1 | 5/2007 | Eslinger | |
| 2008/0078560 | A1 | 4/2008 | Hall | |
| 2009/0035159 | A1 | 2/2009 | Speer et al. | |
| 2010/0272560 | A1 * | 10/2010 | Buell et al. | 415/180 |

OTHER PUBLICATIONS

National Oilwell Varco, Mission Multistage Surface Pump flyer dated 2007; www.nov.com/msp (1 p).

* cited by examiner

SURFACE PUMP ASSEMBLY HAVING A THRUST CHAMBER WITH A TELESCOPING SHAFT

CROSS-REFERENCE TO RELATED APPLICATIONS

This application claims benefit of U.S. provisional application Ser. No. 61/175,706 filed May 5, 2009, and entitled "A Surface Pump Assembly Having a Thrust Chamber with a Telescoping Shaft," which is hereby incorporated herein by reference in its entirety for all purposes.

STATEMENT REGARDING FEDERALLY SPONSORED RESEARCH OR DEVELOPMENT

Not applicable.

BACKGROUND

This disclosure relates generally to a thrust chamber for a centrifugal pump. More particularly, the disclosure relates to a telescoping shaft for the thrust chamber.

One type of surface pump commonly used to inject large volumes of liquid into a well is a centrifugal pump. A typical, conventional centrifugal surface pump 10 is illustrated by FIG. 1. Surface pump 10 is supported on a skid 15, and has a housing 20 with an inlet end 25 and a discharge end 30. Inlet end 25 is fluidicly coupled to an intake chamber 35. Liquid to be pressurized by pump 10 is supplied to inlet end 25 of pump 10 through intake chamber 35. Liquid that has been pressurized by pump 10 is exhausted from pump 10 through discharge end 30.

Pump 10 further includes a shaft 40 and a motor 50 operable to rotor shaft 40. Shaft 40 extends through housing 20 and a number of stages disposed therebetween. Each stage of pump 10 includes an impeller and a diffuser disposed within housing 20 about shaft 40. When shaft 40 rotates, velocity is imparted to liquid passing through pump 10 by the impellers. Interaction of the liquid with the diffusers converts the velocity to pressure. Thus, the liquid is pressurized as it passes through the multiple stages of pump 10.

In reaction to the pressure increase of the liquid, axial thrust is transferred to shaft 40 by the impellers. The thrust load is transferred along shaft 40 to bearings disposed within thrust chamber 45. Thrust chamber 45 further includes one or more mechanical seals disposed about shaft 40 proximate the locations where shaft 40 passes into and out of thrust chamber 45. These mechanical seals prevent the loss of fluid contained within thrust chamber 45 for lubricating and cooling the bearings.

During the life of a surface pump assembly, such as the one described above, the mechanical seal(s) experiences wear and must be replaced regularly, for example, every two years. Bearings in the thrust chamber also experience wear and must be rebuilt or replaced. Such maintenance operations often require the connections to the pump be disconnected and the pump physically moved to enable removal and replacement of the mechanical seal, bearings, or thrust chamber. Consequently, these operations can require a day or more of downtime to perform the necessary maintenance procedure.

Accordingly, there is a need for apparatus that enables quicker removal and replacement of the mechanical seal, bearings, or thrust chamber. It would be particularly desirable if the apparatus enabled access to the mechanical seal or thrust chamber without the necessity to disconnect and move the pump.

SUMMARY OF THE PREFERRED EMBODIMENTS

A thrust chamber for a surface pump assembly is disclosed. In some embodiments, the thrust chamber has a telescoping shaft with a rotatable shaft member, an adjusting nut, and a sleeve. The adjusting nut is threadably disposed about the shaft member and moveable axially relative to the shaft member by rotation. The sleeve is translatably disposed about the shaft member.

In some embodiments, the surface pump assembly includes a pump having a pump shaft, a thrust chamber having a telescoping shaft extending therein, and a motor coupled to the telescoping shaft and operable to rotate the telescoping shaft. The telescoping shaft includes a shaft member and a first sleeve disposed thereabout. The first sleeve is moveable relative to the shaft member between a first position, wherein the first sleeve is coupled to the pump shaft, and a second position, wherein the first sleeve is disengaged from the pump shaft.

Some methods for servicing the thrust chamber include disposing a first sleeve about a shaft member, wherein the first sleeve is coupled to a pump shaft and the shaft member is coupled to a motor, disengaging the first sleeve from the pump shaft, and moving a seal assembly from a first position, wherein the seal assembly is inaccessible, to a second position, wherein the seal assembly is accessible.

Thus, embodiments described herein comprise a combination of features and advantages intended to address various shortcomings associated with certain prior thrust chambers. The various characteristics described above, as well as other features, will be readily apparent to those skilled in the art upon reading the following detailed description of the preferred embodiment, and by referring to the accompanying drawings.

BRIEF DESCRIPTION OF THE DRAWINGS

For a detailed description of the disclosed embodiments, reference will now be made to the accompanying drawings in which.

DETAILED DESCRIPTION OF THE DISCLOSED EMBODIMENTS

Figure 1:
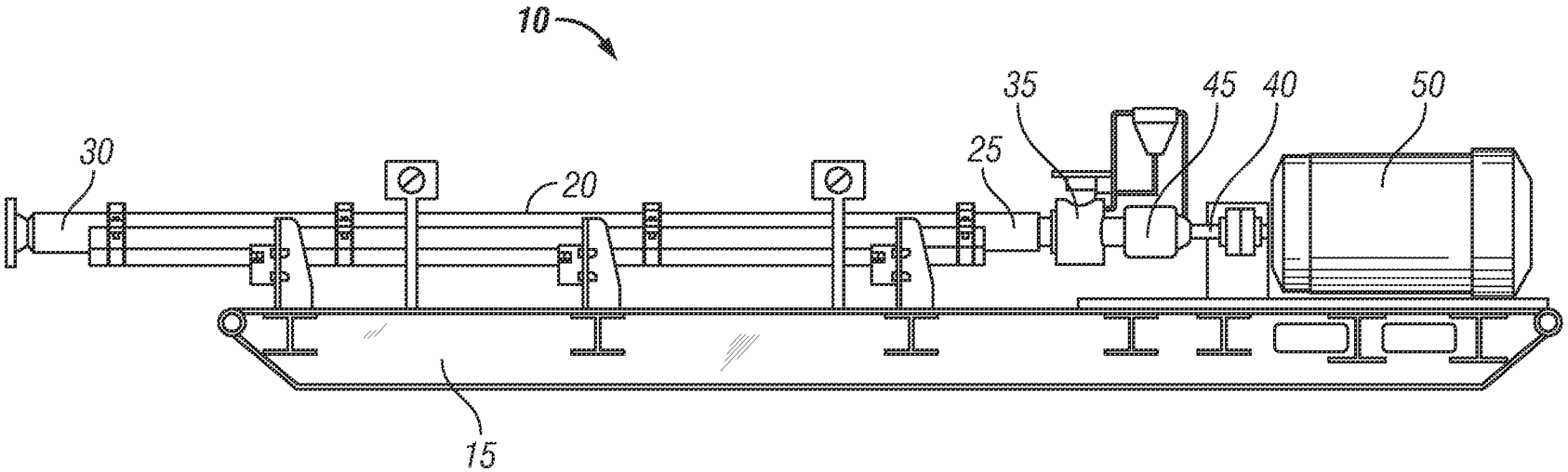
FIG. 1 (Prior Art)
FIG. 1 is schematic view of conventional pump assembly.

The following description is directed to exemplary embodiments of thrust chamber for a surface pump assembly having a centrifugal pump. The embodiment disclosed should not be interpreted, or otherwise used, as limiting the scope of the disclosure, including the claims. One skilled in the art will understand that the following description has broad application, and that the discussion is meant only to be exemplary of the described embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. Moreover, the drawing figures are not necessarily to scale. Certain features and components described herein may be shown exaggerated in scale or in somewhat schematic form, and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection via other devices and connections. Further, the terms "axial" and "axially" generally mean along or parallel to a central or longitudinal axis. The terms "radial" and "radially" generally mean perpendicular to the central or longitudinal axis, while the terms "azimuth" and "azimuthally" generally mean perpendicular to both the central or longitudinal axis and a radial axis normal to the central longitudinal axis. As used herein, these terms are consistent with their commonly understood meanings with regard to a cylindrical coordinate system.

Figure 2:
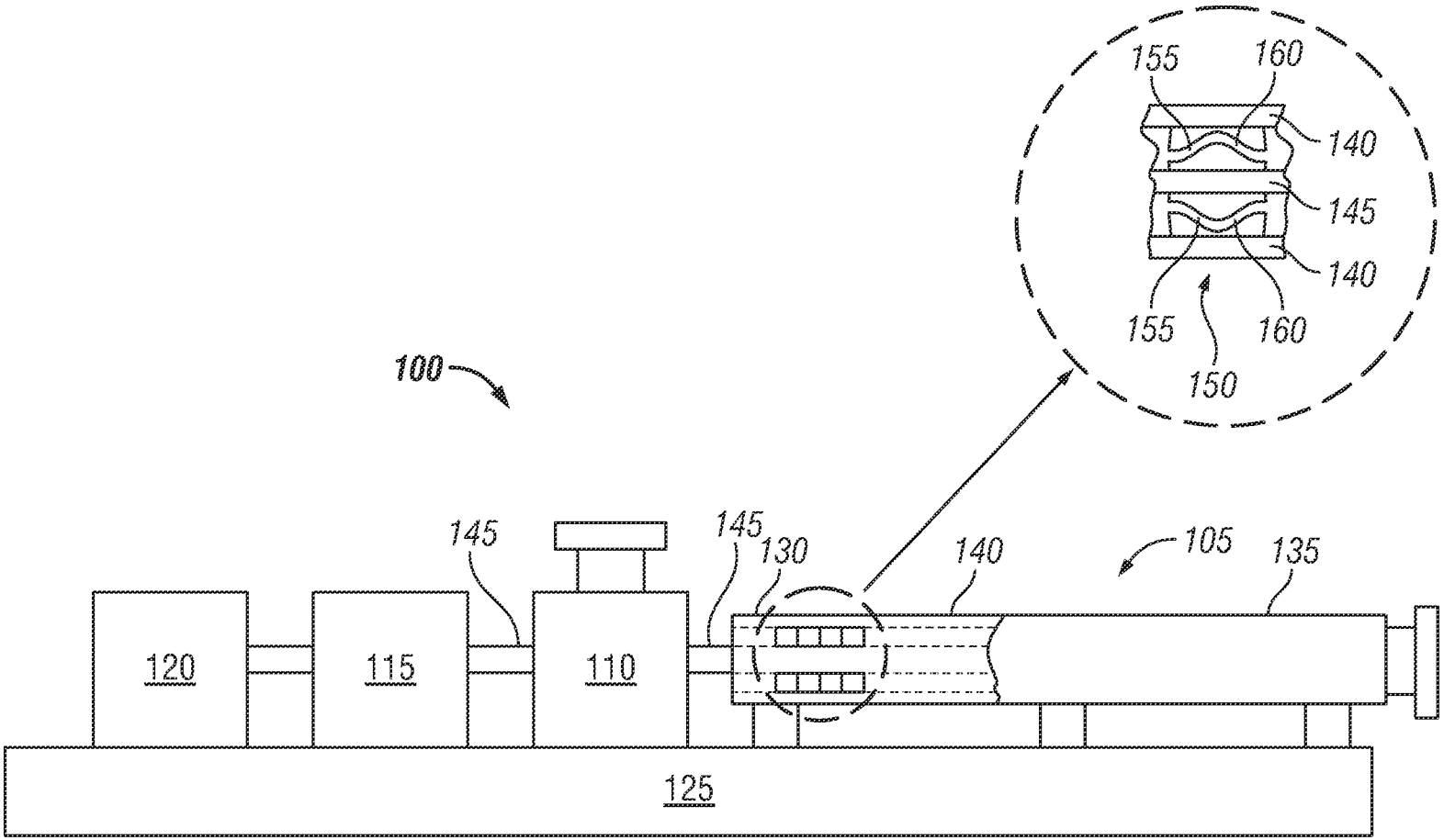
FIG. 2 is a schematic representation of a pump assembly having a thrust chamber with a telescoping shaft in accordance with the principles disclosed herein.

Referring now to FIG. 2, there is shown a surface pump assembly with a thrust chamber having a telescoping shaft in accordance with the principles disclosed herein. Surface pump assembly 100 includes a centrifugal pump 105, an intake chamber 110, a thrust chamber 115, and a motor 120 connected in series and mounted on a skid 125. Pump 105 has a housing 140 with an inlet end 130 and a discharge end 135. Inlet end 130 is fluidicly coupled to, meaning in fluid communication with, intake chamber 110. Liquid to be pressurized by pump 105 is supplied to inlet end 130 of pump 105 through intake chamber 110. Liquid that has been pressurized by pump 105 is exhausted from pump 105 through discharge end 135.

Pump 105 further includes a rotatable shaft 145 extending through housing 140 and a number of stages 150 disposed within housing 140 about shaft 145. Shaft 145 of pump 105 extends from housing 140 through intake chamber 110 to thrust chamber 115. Each stage 150 of pump 105 includes an impeller 155 and a diffuser 160 disposed within housing 140 about shaft 145. When shaft 145 rotates, velocity is imparted to liquid passing through pump 105 by impellers 155. Interaction of the liquid with diffusers 160 converts the velocity to pressure. Thus, the liquid is pressurized as it passes through multiple stages 150 of pump 105. In reaction to the pressure increase of the liquid, axial thrust is transferred to shaft 145 by impellers 155.

Figure 3:
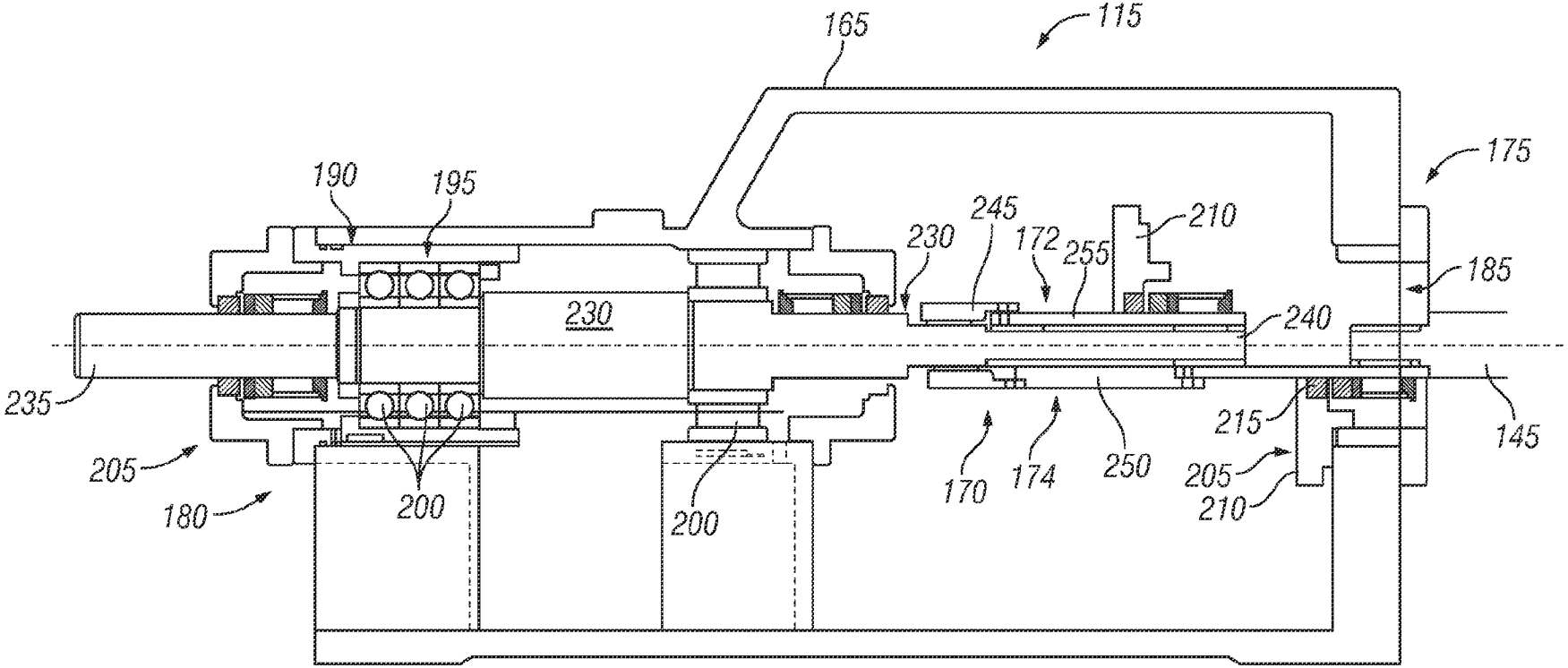
FIG. 3 is a cross-sectional view of the thrust chamber of FIG. 2 with an embodiment of a telescoping shaft shown in two positions, the upper half of the telescoping shaft engaged with the pump shaft and the lower half of the telescoping shaft disengaged from the pump shaft.

Referring next to FIG. 3, thrust chamber 115 includes a housing 165 disposed about a rotatable telescoping shaft 170. A telescoping shaft in accordance with the principles disclosed herein, including shaft 170, derives its name from its ability to extend and to retract within thrust chamber housing 165. FIG. 3 illustrates telescoping shaft 170 in both its extended and retracted configurations. In FIG. 3, the upper half 172 of shaft 170 is shown retracted, and the lower half 174 of shaft 170 is shown extended toward pump shaft 145. When telescoping shaft 170 is retracted, shaft 170 is disconnected from pump shaft 145. Alternatively, when telescoping shaft 170 is extended, shaft 170 may be coupled to pump shaft 145.

Thrust chamber housing 165 includes a pump end 175 and a motor end 180. Pump end 175 of thrust chamber housing 165 is configured to enable coupling of pump shaft 145 with telescoping shaft 170 of thrust chamber 115 when shaft 170 is extended, as illustrated in FIG. 3 by the lower half 174 of shaft 170. In the embodiment shown in FIG. 3, pump end 175 of housing 165 has an opening 185 through which pump shaft 145 and telescoping shaft 170 extend to engage. Motor end 180 of thrust chamber housing 165 includes an opening 190 through which telescoping shaft 170 extends to couple with motor 120 (FIG. 2). Thus, telescoping shaft 170 enables coupling of pump shaft 145 to motor 120.

Proximate motor end 180 of housing 165, thrust chamber 115 further includes a bearing assembly 195 having a plurality of bearings 200 which support and enable rotation of telescoping shaft 170. Fluid is disposed within thrust chamber 115 to lubricate and cool bearings 200. In some embodiments, including those illustrated by FIG. 3, the fluid is oil.

To contain the fluid disposed within thrust chamber housing 165, thrust chamber 115 further includes one or more seal assemblies 205 disposed about telescoping shaft 170. In the embodiments shown in FIG. 3, thrust chamber 115 includes one seal assembly 205 extending into opening 185 of pump end 175 of thrust chamber housing 165. Seal assembly 205 includes a seal housing 210 with a mechanical seal 215 disposed therein. During operation of pump 105, seal housing 210 is coupled to the inner surface of thrust chamber housing 165, such as by bolts. When servicing of thrust chamber 115 is required, such as to replace seal 215, seal housing 210 may be decoupled from thrust chamber housing 165 to enable access to seal 215. Mechanical seal 215 is an annular member disposed about shaft 170. In some embodiments, seal 215 is a Type 1 seal.

Telescoping shaft 170 includes a shaft member 230 having a first end 235 that extends through motor end 180 of thrust chamber housing 165 to couple with motor 120, as previously described, and second end 240 disposed within thrust chamber housing 165. Telescoping shaft 170 further includes an adjusting nut 245, a spacer sleeve 250, and a seal sleeve 255 disposed about shaft member 230 proximate its second end 240. Adjusting nut 245 threadably engages shaft member 230. Thus, rotation of nut 245 about shaft member 230 moves nut 245 axially relative to shaft member 230.

Seal sleeve 255 is a tubular member that is slideable or translatable in the axial direction relative to shaft member 230 between two positions, one of engagement with pump shaft 145, as illustrated by the lower half 174 of shaft 170 in FIG. 3, and one of disengagement from pump shaft 145, as illustrated by the upper half 172 of shaft 170 in this figure. Because seal sleeve 255 is extendable and retractable relative to shaft member 230, shaft 170 may be described as telescoping. The length of seal sleeve 255 is selected such that when seal sleeve 255 translates or extends to engage pump shaft 145 at one end, the opposite end of seal sleeve 255 does not disengage shaft member 230.

Figure 4:
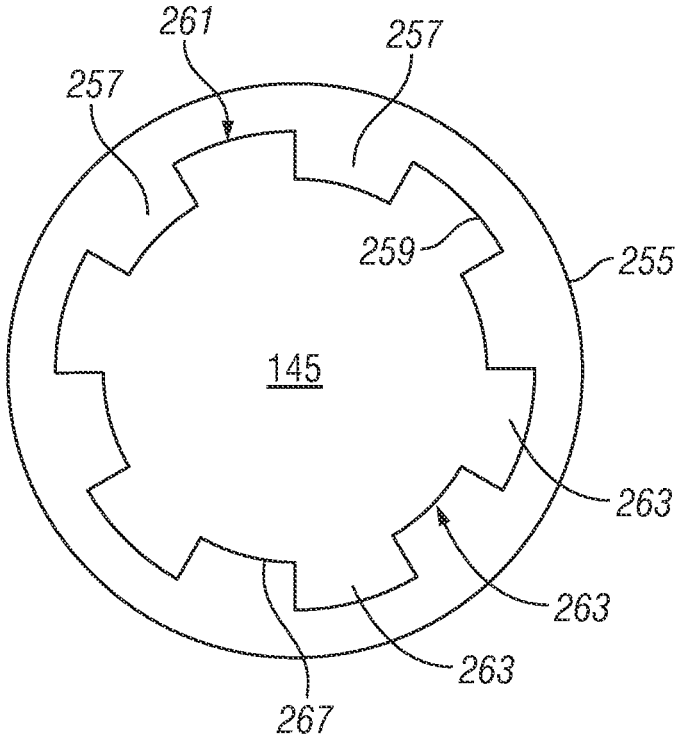
FIG. 4 is a cross-sectional view of the pump shaft interlocked within the seal sleeve.

Seal sleeve 255 is configured to couple with pump shaft 145 when extended, as illustrated in FIG. 3 by the lower half 174 of shaft 170. When seal sleeve 255 and pump shaft 145 are coupled, rotational loads to seal sleeve 255 are transferred to pump shaft 145. In the embodiment shown, seal sleeve 255 and pump shaft 145 interlock via plurality of lugs disposed on each to enable transfer of rotational load from seal sleeve 255 to pump shaft 145. As best viewed in FIG. 4, seal sleeve 255 has a plurality of lugs 257 extending radially inward from its inner surface 259. A recess 261 is formed between each pair of adjacent lugs 257. Similarly, pump shaft 145 has a plurality of lugs 263 extending radially outward from its outer surface 267. A recess 269 is formed between each pair of adjacent lugs 263. When seal sleeve 255 is extended relative to shaft member 230, seal sleeve 255 receives pump shaft 145 therein with lugs 263 of pump shaft 145 disposed within recesses of seal sleeve 255 and lugs 257 disposed within recesses 269 of pump shaft 145. Thus, seal sleeve 255 and pump shaft 145 are interlocked and rotational load may be transferred therebetween.

Seal assembly 205 proximate pump end 175 of thrust chamber housing 165 is disposed about seal sleeve 255. When seal housing 210 is decoupled from thrust chamber housing 165 and seal sleeve 255 translates relative to shaft member 230, seal housing 210 and mechanical seal 215 move with seal sleeve 255. Thus, translation of seal sleeve 255 toward adjusting nut 245 enables separation of seal housing 210 from thrust chamber housing 165 and allows access to mechanical seal 215. Subsequent translation of seal sleeve 255 in the opposite direction enables recoupling of seal housing 210 to thrust chamber housing 165 with mechanical seal 215 being disposed in opening 185.

As illustrated by the lower half 174 of telescoping shaft 170 in FIG. 3, spacer sleeve 250 is a tubular member which may be coupled between adjusting nut 245 and seal sleeve 255. When so installed, spacer sleeve 250 enables the transfer of axial load from seal sleeve 255 to shaft member 230. Also, spacer sleeve 250 enables seal sleeve 255 to remain coupled to pump shaft 145.

During operation of pump 105, liquid to be pressurized by pump 105 is supplied through intake chamber 110 to inlet end 130 of pump 105. Motor 120 rotates telescoping shaft 170 of thrust chamber 115 and pump shaft 145 coupled thereto. As pump shaft 145 rotates, liquid passing through pump 105 is pressurized. The thrust load imparted to pump shaft 145 in reaction to the liquid pressurization is transferred from pump shaft 145 along telescoping shaft 170 to bearings 200 within thrust chamber 115. In particular, the axial load imparted from pump shaft 145 is transferred along seal sleeve 255, spacer sleeve 250, adjusting nut 245, and shaft member 230 to bearings 200. Liquid contained within thrust chamber housing 165 by seal assemblies 205 lubricates and cools bearings 200 as telescoping shaft 170 rotates.

Over time, mechanical seal 215 may wear and require replacement. When such maintenance operations become necessary, pump 105 is turned off, and seal housing 210 is decoupled from thrust chamber housing 165. Telescoping shaft 170 is then retracted to disengage or decouple from pump shaft 145. To disengage telescoping shaft 170 from pump shaft 145, spacer sleeve 250 is decoupled from adjusting nut 245 and seal sleeve 255, and seal sleeve 255 is translated along shaft member 230 toward adjusting nut 245, as illustrated by the upper half 172 of shaft 170 in FIG. 3. Translation of seal sleeve 255 toward adjusting nut 245 enables seal sleeve 255 to disengage pump shaft 145. Because sealing housing 210 has been decoupled from thrust chamber housing 165, seal housing 210 and mechanical seal 215 translate with seal sleeve 255 toward adjusting nut 245, enabling access to mechanical seal 215. Seal 215 may then be serviced, including inspection, repair, and/or replacement of seal 215.

After replacement of mechanical seal 215, telescoping shaft 170 is extended to again engage pump shaft 145 and to reassemble seal housing 210 with new mechanical seal 215 disposed therein. Seal sleeve 255 is translated to engage pump shaft 145. Translation of seal sleeve 255 returns seal housing 220 of seal assembly 205 to engagement with thrust chamber housing 165, enabling these components to be again coupled with mechanical seal 215 disposed within opening 185. Spacer sleeve 250 is then coupled between adjusting nut 245 and seal sleeve 255 to enable load transfer between shaft member 230 of telescoping shaft 170 and pump shaft 145. Operation of pump 105 may then resume.

Also over time, bearings 200 may wear and need to be rebuilt or replaced. When this becomes necessary, pump 105 is turned off, and telescoping shaft 170 is retracted to disengage pump shaft 145, as described above. Thrust chamber 115 may then be disconnected from motor 120 and removed from pump assembly 100 to enable bearings 200 to be replaced or rebuilt. After servicing to bearings 200 is complete, thrust chamber 115 is then repositioned between motor 120 and intake chamber 110, and reconnected to motor 120. Telescoping shaft 170 of thrust chamber 115 is then extended to again engage pump shaft 145 and to reassemble seal housing 210, both as described above. Operation of pump 105 may then resume.

Figure 5:
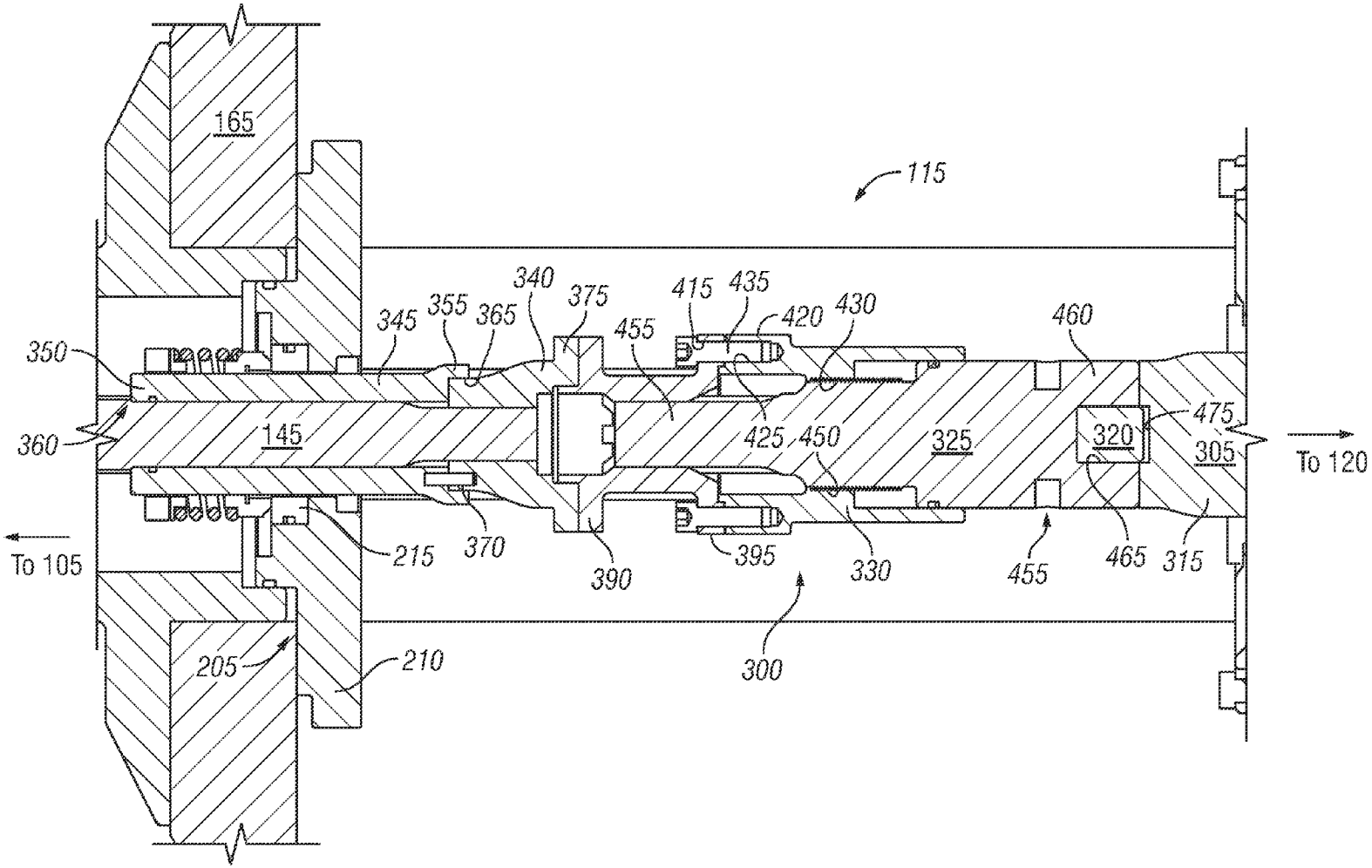
FIG. 5 is a cross-sectional view of the thrust chamber of FIG. 2 with another embodiment of a telescoping shaft.

Turning now to FIG. 5, an alternative embodiment of a telescoping shaft for thrust chamber 115 is shown. Telescoping shaft 300 includes a shaft member 305 having a first end 235 (FIG. 3) that extends through motor end 180 of thrust chamber housing 165 to couple with motor 120, as previously described, and second end 315 disposed within thrust chamber housing 165. Proceeding from right to left in FIG. 5, telescoping shaft 300 further includes a coupling pilot 320, a coupling shaft 325, a coupling spacer 330, a thrust chamber half coupling 335, a pump half coupling 340, and a seal sleeve 345.

Seal sleeve 345 is a tubular member having two ends 350, 355 and configured to receive pump shaft 145 therethrough. When telescoping shaft 300 is installed between thrust chamber 115 and pump 105, as shown, pump shaft 145 is received within seal sleeve 345 with end 350 of seal sleeve 345 abutting a shoulder 360 formed on the outer surface of pump shaft 145. End 355 of seal sleeve 345 has a recessed portion 365.

Figure 6:
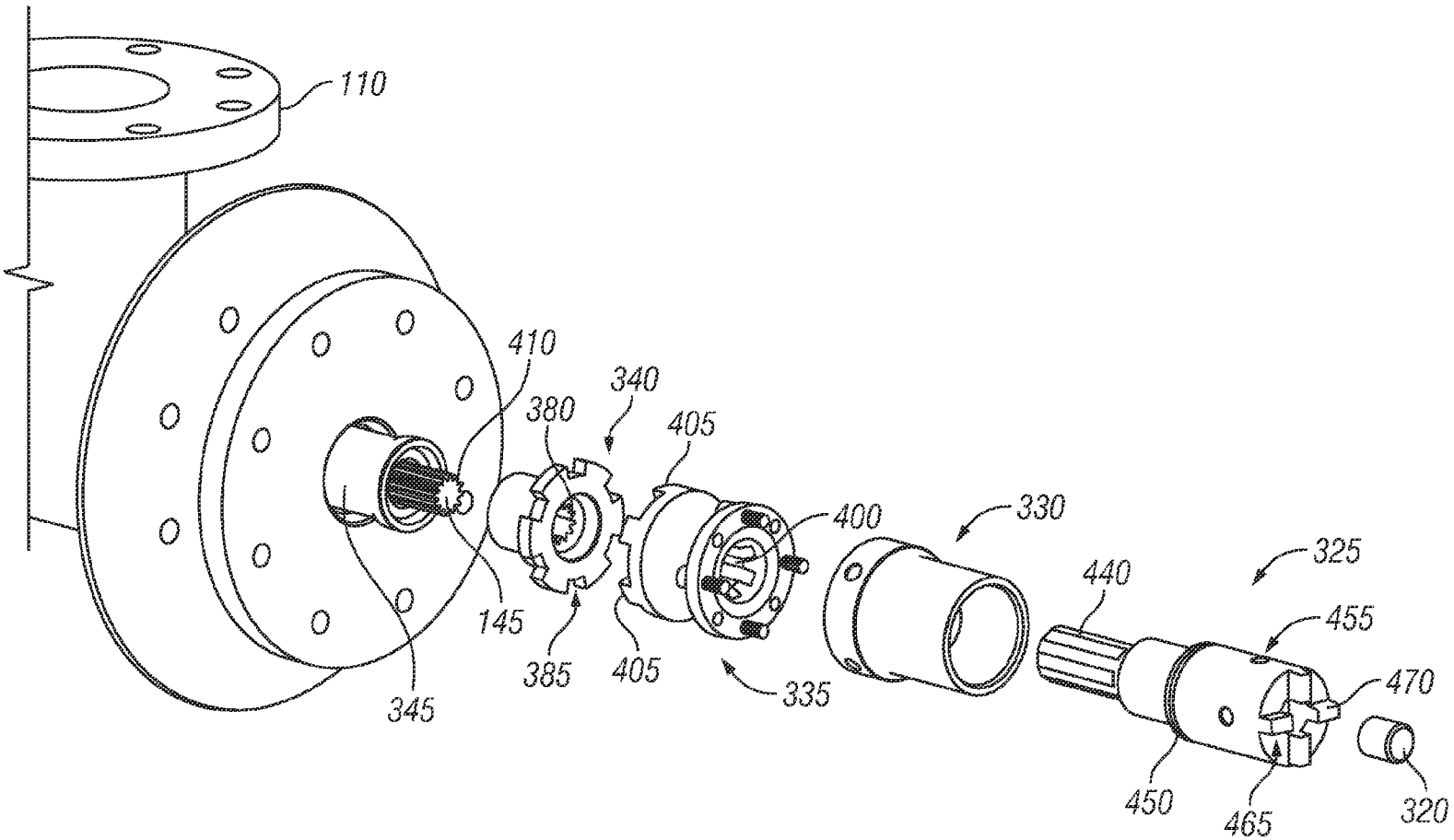
FIG. 6 is a perspective, exploded view of the telescoping shaft of FIG. 5.

Pump half coupling 340 is an annular ring-shaped member having two ends 370, 375 and a plurality of axially or longitudinally extending splines 380 disposed on its inner surface, as best viewed in FIG. 6. Referring to both FIGS. 5 and 6, end 370 of pump half coupling 340 is configured to be received within recessed portion 365 of seal sleeve 345, such that pump half coupling 340 seats against seal sleeve 345. End 375 of pump half coupling 340 is flanged with a plurality of recesses 385 formed along its periphery. Splines 380 are configured to interlock with mating splines 410 formed on the outer surface of pump shaft 145 to couple pump half coupling 340 and pump shaft 145 when telescoping shaft 300 is installed between thrust chamber 115 and pump 105. When splines 380, 410 are interlocked, rotational loads to pump half coupling 340 are transferred to pump shaft 145.

Thrust chamber half coupling 335 is tubular member with two flanged ends 390, 395 and a plurality of axially or longitudinally extending splines 400 disposed along its inner surface. Flanged end 390 has a plurality of axially extending lugs 405. When telescoping shaft 300 is installed between thrust chamber 115 and pump 105, each lug 405 of flanged end 390 of thrust chamber half coupling 335 is received within a recess 385 of flanged end 375 of pump half coupling 340 such that these half couplings 335, 340 are coupled. When coupled, rotational loads to thrust chamber half coupling 335 are transferred to pump half coupling 340 via interlocked lugs 405 and recesses 385. Flanged end 395 has a plurality of axially extending throughbores 415 disposed about its periphery.

Coupling spacer 330 is a tubular member having a flanged end 420 with a plurality of axially extending threaded bores 425 and a plurality of threads 430 formed over a portion of its inner surface. Threaded bores 425 of coupling spacer 330 align with throughbores 415 of thrust chamber half coupling 335 to enable coupling of these components 330, 335 via a threaded bolt 435 inserted through each pair of aligned bores 415, 425.

Coupling shaft 325 is a cylindrical member having a plurality of splines 440 disposed about its outer surface proximate one end 445. Splines 440 are configured to interlock with splines 400 of thrust chamber half coupling 335 when end 445 of coupling shaft 325 is inserted through coupling spacer 330 into thrust chamber half coupling 335, as shown. Coupling shaft 325 further includes a plurality of threads 450 disposed on its outer surface proximate its midsection and a plurality of circumferentially spaced bores 455 disposed on its outer surface and axially displaced from threads 450. Threads 450 are configured to rotatably engage threads 430 of coupling spacer 330 when coupling shaft 325 is inserted within coupling spacer 330, as shown. Bores 455 are each configured to receive a rod, wherein a torque load applied to the rod enables relative rotation of coupling shaft 320 and coupling spacer 330, such that coupling spacer 330 threads onto or unthreads from coupling 330.

At an end 460, coupling shaft 325 further includes a circular recess 465 and a plurality of ribs 470 extending radially from recess 465 and axially from end 460. End 315 of shaft member 305 includes a circular recess 475 and a plurality of recesses (not shown) extending radially from recess 475. When telescoping shaft 300 is installed between pump shaft 145 and motor 120, as shown, end 460 of coupling shaft 325 abuts end 315 of shaft member 305 such that circular recesses 465, 475 align, and each recess of shaft member 305 aligns with and receives therein a rib 470 of coupling shaft 325. Coupling pilot 320 is a cylindrically shaped member configured to be received within aligned circular recesses 465, 475. Engagement of ribs 470 of coupling shaft 325 with recesses of shaft member 305 in this manner enables shaft member 305 and coupling shaft 325 to be coupled. When coupled, rotational loads to shaft member 305 are transferred to coupling shaft 325.

During operation of pump 105, liquid to be pressurized by pump 105 is supplied through intake chamber 110 to inlet end 130 of pump 105. Motor 120 rotates telescoping shaft 300 of thrust chamber 115 and pump shaft 145 coupled thereto. As pump shaft 145 rotates, liquid passing through pump 105 is pressurized. The thrust load imparted to pump shaft 145 in reaction to the liquid pressurization is transferred from pump shaft 145 along telescoping shaft 300 to bearings 200 within thrust chamber 115. Liquid contained within thrust chamber housing 165 by seal assemblies 205 lubricates and cools bearings 200 as telescoping shaft 300 rotates.

Over time, mechanical seal 215 (FIG. 5) may wear and require replacement. When such maintenance operations become necessary, pump 105 is turned off, and telescoping shaft 300 is decoupled from pump shaft 145. To disengage telescoping shaft 300 from pump shaft 145, bolts 435 coupled between thrust chamber half coupling 335 and coupling spacer 330 are removed. A rod is inserted into one of bores 455 on the outer surface of coupling shaft 325. A torque load is applied to the rod to prevent rotation of coupling shaft 325 while coupling spacer 330 is rotated relative to coupling shaft 325 toward shaft member 305. When coupling spacer 330 has translated axially toward shaft member 305 and away from pump half coupling 340 a sufficient distance, lugs 405 of thrust chamber half coupling 335 disengage recesses 385 of pump half coupling 340, and thrust chamber half coupling 335 is free to move relative to pump half coupling 340.

Coupling spacer 330 is further threaded toward shaft member 305 to enable additional clearance between thrust chamber half coupling 335 and pump half coupling 340. The additional clearance enables coupling shaft 325, with coupling spacer 330 and thrust chamber half coupling 335, to be moved relative to shaft member 305 to disengage ribs 470 of coupling shaft 325 from the mating recesses on shaft member 305. Coupling spacer 330, thrust chamber half coupling 335, and coupling shaft 325 may then be removed from thrust chamber 115 to enable access to and replacement of mechanical seal 215.

Figure 7A:
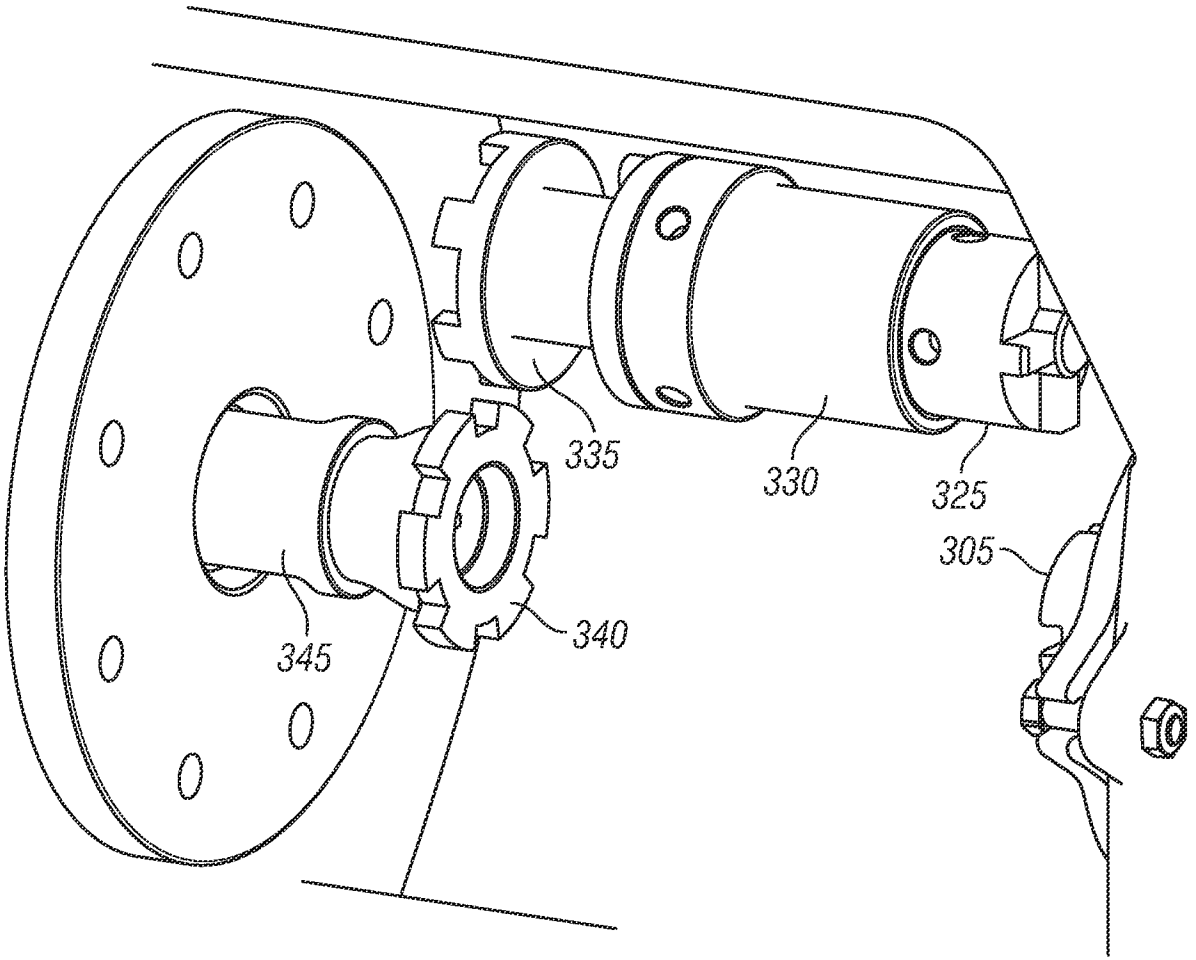
FIGS. 7A through 7D are schematic views of the telescoping shaft of FIG. 5, illustrating assembly and installation of the telescoping shaft.
Figure 7B:
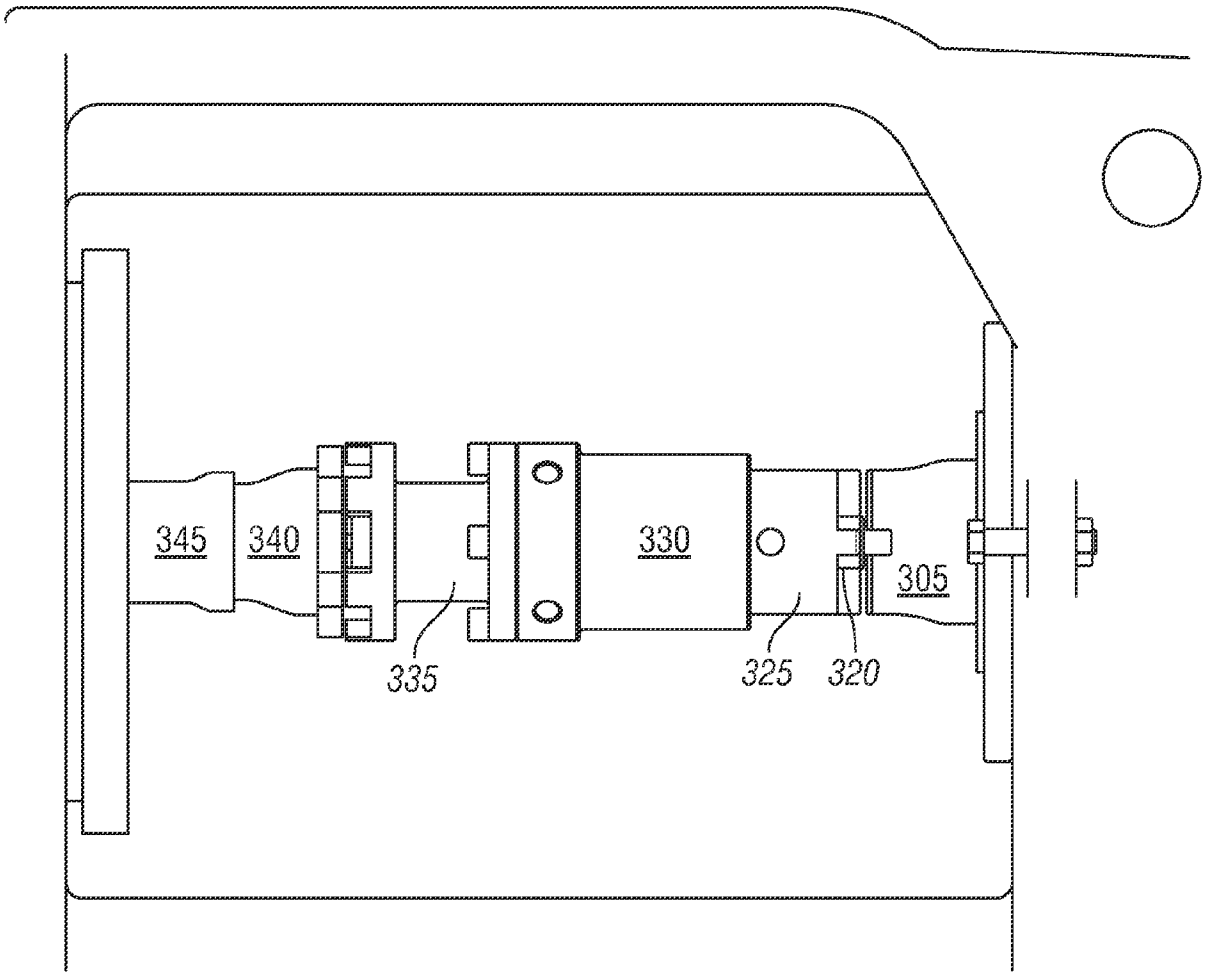
Figure 7C:
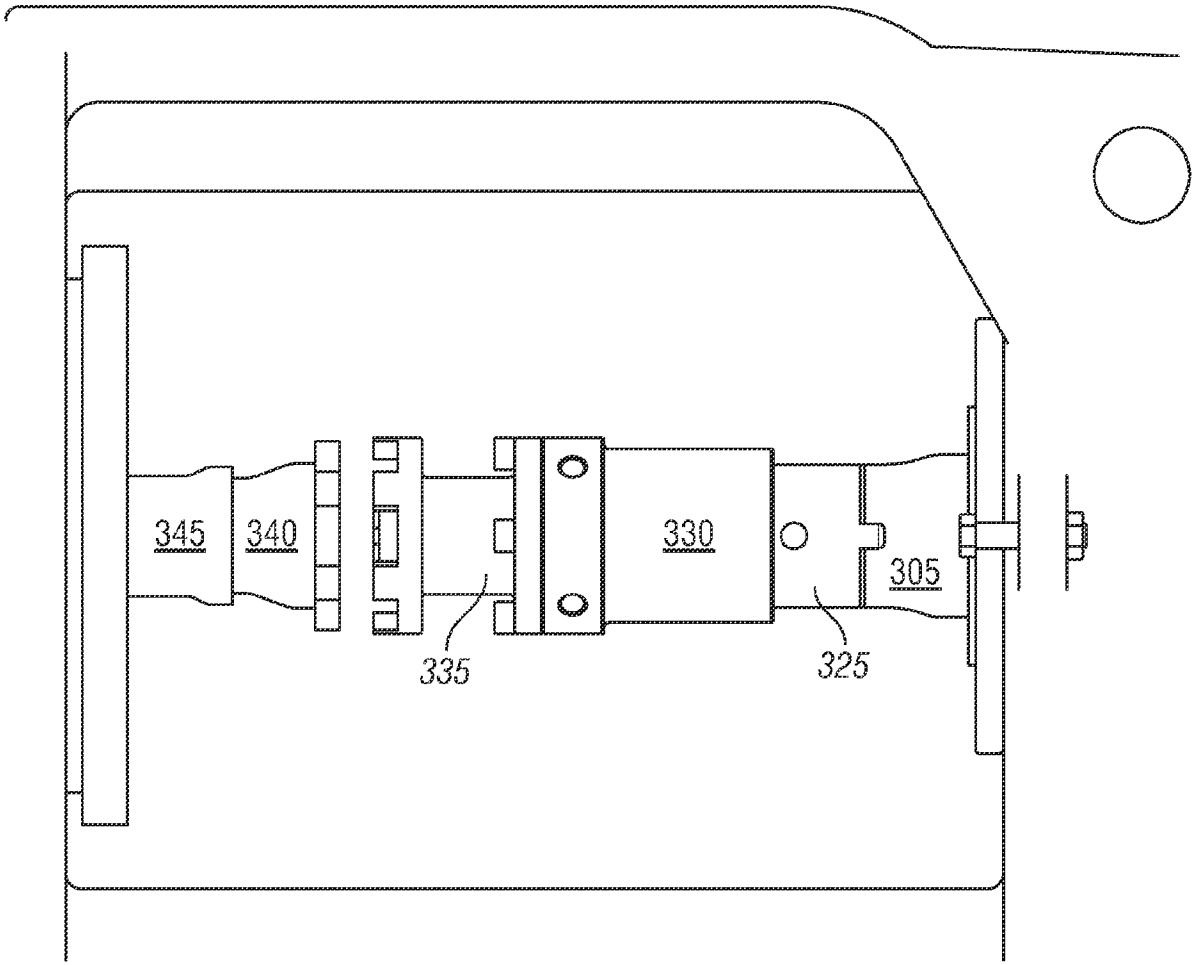
Figure 7D:
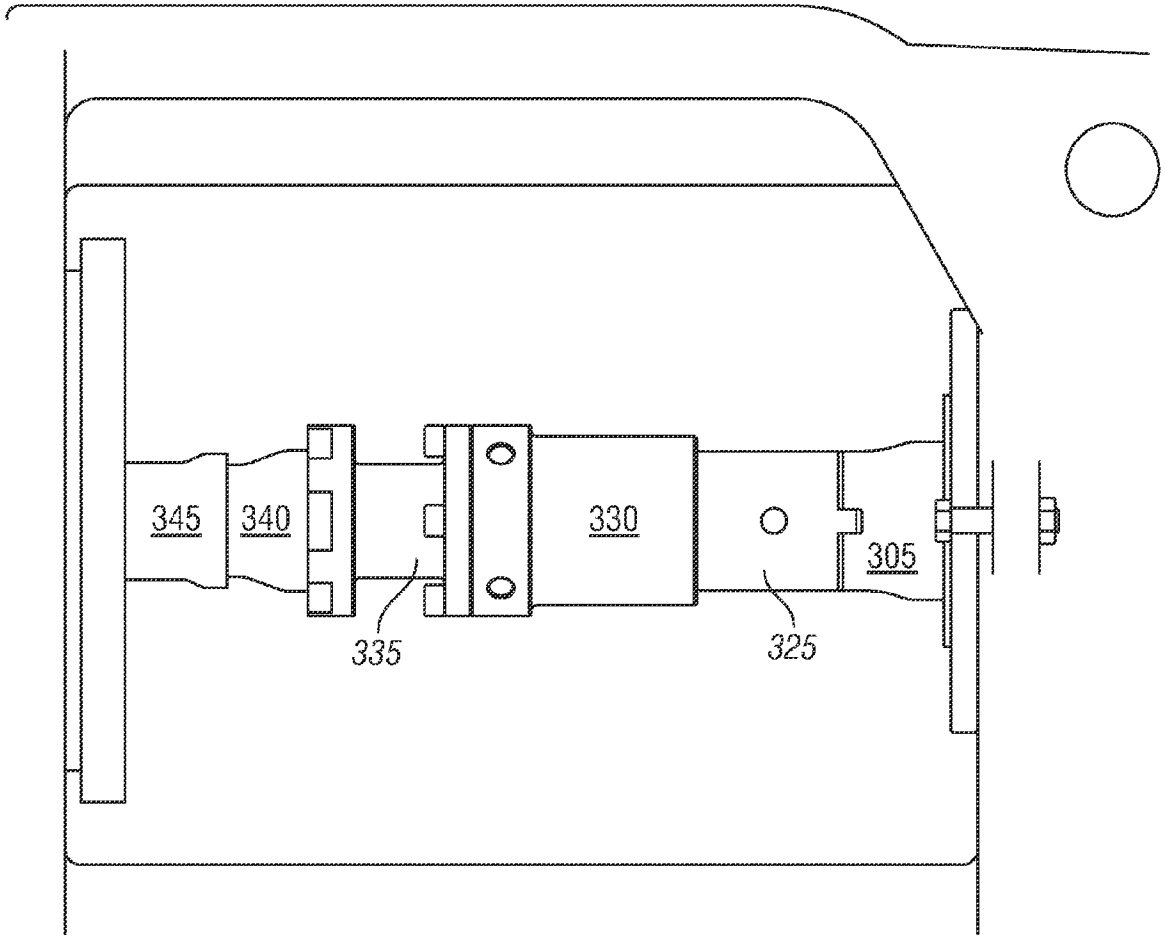

After replacement of mechanical seal 215, coupling spacer 330, thrust chamber half coupling 335, and coupling shaft 325 are reinstalled within thrust chamber 115. Bolts 435 are recoupled between thrust chamber half coupling 335 and coupling spacer 330. Coupling spacer 330, thrust chamber half coupling 335, and coupling shaft 325 are axially aligned between pump half coupling 340 and shaft member 305, as illustrated by FIGS. 7A and 7B. Coupling spacer 330, thrust chamber half coupling 335, and coupling shaft 325 are then translated toward shaft member 305 to enable ribs 470 of coupling shaft 325 to seat within the mating recesses on shaft member 305, as illustrated by FIG. 7C. The rod is then reinserted within a bore 455 on the outer surface of coupling shaft 325 to prevent rotation of coupling shaft 325, while coupling spacer 330 is rotated about coupling shaft 325 until lugs 405 of thrust chamber half coupling 335 are again seated within recesses 385 of pump half coupling 340, as shown in FIG. 7D. Additional torque may be applied to coupling spacer 330 to ensure secure engagement of telescoping shaft 300 between pump shaft 145 and motor 120. Operation of pump 105 may then resume.

Also over time, bearings 200 may wear and need to be rebuilt or replaced. When this becomes necessary, pump 105 is turned off. Thrust chamber half coupling 335, coupling spacer 330, and coupling shaft 325 may then be removed in a manner described above. Next, pump half coupling 340 and seal sleeve 345 are disengaged from pump shaft 145 and removed. Finally, thrust chamber 115 is disconnected from motor 120 and removed from pump assembly 100 to enable bearings 200 to be replaced or rebuilt.

After servicing to bearings 200 is complete, thrust chamber 115 is then repositioned between motor 120 and intake chamber 110, and reconnected to motor 120. Telescoping shaft 300 of thrust chamber 115 is reinstalled to again engage pump shaft 145. Seal sleeve 345 is installed over pump shaft 145, and pump half coupling 340 is seated within recessed portion 365 of seal sleeve 345. Thrust chamber half coupling 335, coupling spacer 330, and coupling shaft 325 may then be reinstalled in a manner described above. Operation of pump 105 may then resume.

Servicing of certain conventional thrust chambers typically requires decoupling of multiple pump connections and displacement or relocation of the pump to enable sufficient clearance to access the mechanical seal or thrust chamber. Due to the telescoping ability of shafts 170, 300 of thrust chamber 115 disclosed herein, movement of pump 105 is not required to access either mechanical seal 215 or thrust chamber 115. Consequently, telescoping shafts 170, 300 of thrust chamber 115 enables quicker replacement of mechanical seal 215 or servicing to bearings 200 of thrust chamber 115, and therefore less down time.

While various embodiments have been showed and described, modifications thereof can be made by one skilled in the art without departing from the spirit and teachings herein. The embodiments herein are exemplary only, and are not limiting. Many variations and modifications of the apparatus disclosed herein are possible and within the scope of the invention. Accordingly, the scope of protection is not limited by the description set out above, but is only limited by the claims which follow, that scope including all equivalents of the subject matter of the claims.

What is claimed is:

1. A thrust chamber for a surface pump assembly, the thrust chamber comprising:

a telescoping shaft including:

a rotatable shaft member having a central axis;

an adjusting nut threadably mounted to the rotatable shaft, wherein the adjusting nut is moveable axially relative to the shaft member by rotation; and a first sleeve slidably mounted to the shaft member, wherein the first sleeve is configured to move axially relative to the shaft member;

a housing disposed about the telescoping shaft and having an opening;

a seal assembly disposed about the first sleeve, wherein the seal assembly is configured to move axially with the first sleeve relative to the shaft member between a first position disposed in the opening of the housing and a second position removed from the opening of the housing.

2. The thrust chamber of claim 1, wherein the telescoping shaft further comprises a second sleeve removably coupled between the adjusting nut and the first sleeve, whereby the first sleeve is in the first position and immovable relative to the shaft member.

3. The thrust chamber of claim 1, wherein the seal assembly comprises a seal housing and a seal disposed therein.

4. The thrust chamber of claim 1, wherein the telescoping shaft further comprises a second sleeve removably coupled between the adjusting nut and the first sleeve, whereby the first sleeve is immovable relative to the shaft member.

5. The thrust chamber of claim 4, further comprising a plurality of bearings supporting the telescoping shaft, the bearings under load from the shaft member.

6. A surface pump assembly comprising:

a pump having a pump shaft;

a thrust chamber comprising a housing with an opening receiving an end of the pump shaft;

a telescoping shaft extending through the thrust chamber, wherein the telescoping shaft comprises a shaft member having a central axis and a first sleeve disposed about the shaft member, wherein the first sleeve is configured to move axially relative to the shaft member between a first position with the first sleeve coupled to the end of the pump shaft and a second position with the first sleeve disengaged from the end of the pump shaft;

a seal assembly disposed about the first sleeve and moveable with the first sleeve relative to the shaft member, wherein the seal assembly is configured to be releasably coupled to the housing with the first sleeve in the first position; and a motor coupled to the shaft member and operable to rotate the shaft member and first sleeve.

7. The surface pump assembly of claim 6, wherein the first sleeve comprises a plurality of radially extending lugs that interlock with a plurality of radially extending lugs on the pump shaft when the first sleeve is in the first position.

8. The surface pump assembly of claim 7, wherein the seal assembly extends into the opening with the first sleeve in the first position.

9. The surface pump assembly of claim 6, further comprising a plurality of bearings supporting the telescoping shaft, the bearings under load transferred from the pump shaft through the telescoping shaft.

10. The surface pump assembly of claim 6, wherein the telescoping shaft further comprises:

an adjusting nut threadably mounted to the shaft member, wherein the adjusting nut is moveable axially relative to the shaft member by rotation.

11. The surface pump assembly of claim 10, wherein the telescoping shaft further comprises a second sleeve coupled between the adjusting nut and the first sleeve when the first sleeve is in the first position, whereby the first sleeve is immovable relative to the shaft member.

12. A method for servicing a thrust chamber of a surface pump assembly, the method comprising;

disposing a first sleeve about a shaft member, wherein the first sleeve is coupled to a pump shaft and the shaft member is coupled to a motor;

disengaging the first sleeve from the pump shaft; and moving a seal assembly from a first position, wherein the seal assembly is inaccessible, to a second position wherein the seal assembly is accessible;

servicing a seal after said moving; and translating the first sleeve to engage the pump shaft, thereby returning the seal assembly to the first position.

13. The method of claim 12, wherein said disengaging comprises:

translating the first sleeve relative to the shaft member, said translating causing the first sleeve to disengage the pump shaft.

14. The method of claim 13, wherein the seal assembly is disposed about the first sleeve and wherein said translating causes said moving.

15. The method of claim 13, further comprising removing a second sleeve member coupled to the first sleeve, the first sleeve prevented from movement relative to the shaft member when coupled to the second sleeve and permitted to move relative to the shaft member when decoupled from the second sleeve.

* * * * *